United States Patent [19]

Müller

[11] 4,283,048

[45] Aug. 11, 1981

[54] DEVICE FOR SEPARATING OUT FOLDED SPOILED COPIES IN WEB-FED ROTARY PRINTING MACHINES

[75] Inventor: Hans Müller, Leimen, Fed. Rep. of Germany

[73] Assignee: Heidelberger Druckmaschinen AG, Heidelberg, Fed. Rep. of Germany

[21] Appl. No.: 90,983

[22] Filed: Nov. 5, 1979

[30] Foreign Application Priority Data

Nov. 6, 1978 [DE] Fed. Rep. of Germany ..... 2848010

[51] Int. Cl.[3] ..... B65H 29/62

[52] U.S. Cl. ..... 271/302; 198/369; 271/303

[58] Field of Search ..... 271/302, 303, 304, 305, 271/279, 300, 198, 200, 202, 203, 216; 198/369, 436; 93/93 R

[56] References Cited

U.S. PATENT DOCUMENTS

| | | | |
|---|---|---|---|
| 2,533,184 | 12/1950 | Trump | 271/302 |
| 4,015,840 | 4/1977 | Schröder | 271/302 |
| 4,151,986 | 5/1979 | Kawada | 271/303 |

FOREIGN PATENT DOCUMENTS

| | | | |
|---|---|---|---|
| 562828 | 7/1929 | Fed. Rep. of Germany | 271/303 |

*Primary Examiner*—Bruce H. Stoner, Jr.
*Attorney, Agent, or Firm*—Herbert L. Lerner; Laurence A. Greenberg

[57] ABSTRACT

Device for separating out copies in web-fed rotary printing machines at a delivery of a folding apparatus having a main conveyor belt whereon a stream of folded copies are transported in overlapping, fish scale-like arrangement includes a roller pair adjacent the main conveyor belt for deflecting the stream of copies in a fanned-out manner, the deflecting roller pair including one deflecting roller rotatably supporting the main conveyor belt and another deflecting roller located upstream of the one deflecting roller and disposed in substantially horizontal alignment therewith, the other deflecting roller being engageable with the main conveyor belt so as to deflect it and the stream of copies in downward direction, a short additional conveyor belt drivingly engaged by the other deflecting roller and swingable about the other deflecting roller into a normal operating position thereof for transporting properly printed copies to a delivery system and also swingable about the other deflecting roller into another operating position thereof for transporting spoiled copies to a distribution belt, a tensioning roller rotatably supporting the short additional conveyor belt and swingable therewith about the other deflecting roller, a linkage system comprising a rocker lever and a coupling bar coupling the rocking lever to the tensioning lever, a separating roller carried by the rocking lever at a free end thereof and being swingable in among the fanned-out copies by the linkage system as the short additional conveyor belt is swung about the other deflecting roller into the other operating position.

3 Claims, 5 Drawing Figures

Figure 1:
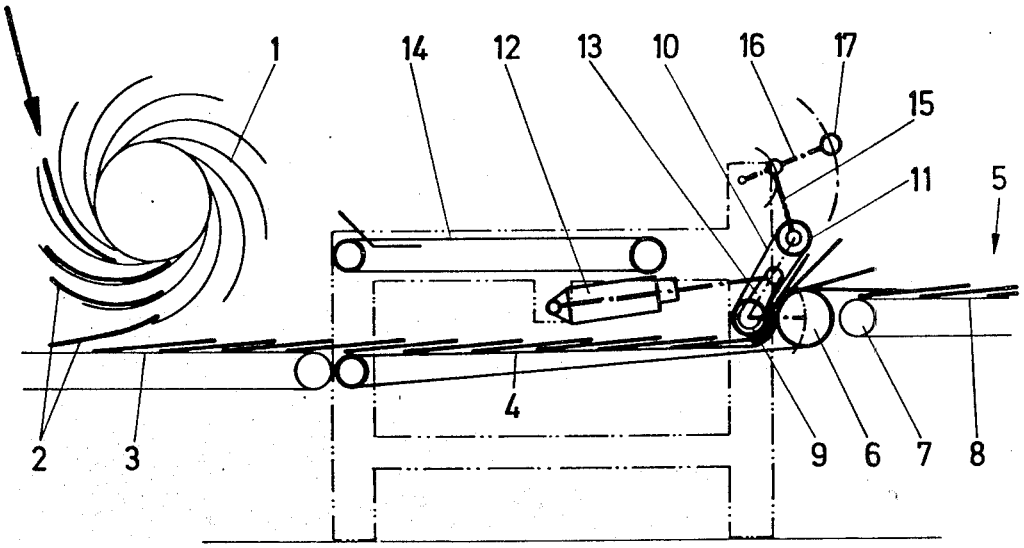

DEVICE FOR SEPARATING OUT FOLDED SPOILED COPIES IN WEB-FED ROTARY PRINTING MACHINES

The invention relates to a device for separating out folded waste or spoiled copies in web-fed rotary printing machines at a delivery of a folding apparatus having a conveyor belt whereon a stream of folded copies are transported in overlapping or fish scale-like arrangement, a roller pair for deflecting the stream of copies in a fan-like manner, and a separating roller swingable in among the fanned-out copies to divert the stream of copies for separating out the waste or spoiled copies.

A device has become known heretofore from German Pat. No. 25 13 774 wherein a stream of copies has been diverted by a separating roller in order, for example, to separate out waste or spoiled copies occurring in vicinity of the gumming or pasting equipment during the changing of rollers. The diverted-spoiled copies are seized by a drum about which bands or tapes are slung and are transported onward at the higher conveyor speed of the drum. This acceleration of the individual copies is necessary to achieve separation of the stream of copies and, after the spoiled copies have been removed, to restore the transport of the copies to the proper direction of travel to the delivery.

Due to the acceleration of the spoiled copies, the normal overlapping or fish scale-like stream of copies is disrupted since each spoiled copy being accelerated is withdrawn fully from beneath the following copies which are disposed overlappingly or fish scale-like upon one another whereby the latter are shifted or displaced on the conveyor belt, which presents a disadvantage of the hereinaforementioned known device. This can, in fact, lead to considerable trouble during subsequent after-treatment or processing of the stream of copies.

It is accordingly an object of the invention to provide a device for separating out folded spoiled copies in web-fed rotary printing machines which is relatively simple to construct and affords separation without any disruption of the overlapping or fish scale-like stream of copies. Moreover, it is an object of the invention to provide such a device wherein the spoiled copies which are to be separated out are not accelerated.

With the foregoing and other objects in view, there is provided, in accordance with the invention, a device for separating out folded waste or spoiled copies in web-fed rotary printing machines at a delivery of a folding apparatus having a main conveyor belt whereon a stream of folded copies are transported in overlapping, fish scale-like arrangement including a roller pair adjacent the main conveyor belt for deflecting the stream of copies in a fanned-out manner, the deflecting roller pair including one deflecting roller rotatably supporting the main conveyor belt and, as viewed in transport direction of the stream of copies, another deflecting roller located upstream of the one deflecting roller and disposed in substantially horizontal alignment therewith, the other deflecting roller being engageable with the main conveyor belt so as to deflect it and the stream of copies in downward direction and, thereby effect the fanning-out of the copies between the rollers of the deflecting roller pair, a short additional conveyor belt drivingly engaged by the other deflecting roller and swingable about the other deflecting roller into a normal operating position thereof for transporting properly printed copies to a delivery system and also swingable about the other deflecting roller into another operating position thereof for transporting spoiled copies to a distribution belt, a tensioning roller rotatably supporting the short additional conveyor belt and swingable therewith about the other deflecting roller, a linkage system including a rocker lever and a coupling bar coupling the rocking lever to the tensioning roller, a separating roller carried by the rocking lever at a free end thereof and being swingable in among the fanned-out copies by the linkage system as the short additional conveyor belt is swung about the other deflecting roller into the other operating position, the separating roller being engageable with the fanned-out copies for feeding the following spoiled copies in overlapping fish scale-like manner over the short additional conveyor belt to the distribution belt. In addition to the relatively simple construction of the device according to the invention, the device ensures reliable separation of the spoiled from the properly printed copies even when the number of pages is small without requiring the spoiled pages, which have been separated out, to be accelerated, thereby preventing the properly printed copies from being shifted or displaced on the belts and accordingly avoiding any disruptions of the stream of copies.

In accordance with another feature of the invention, the device includes lever means for connecting the one roller to the shaft of the other roller of the deflecting roller pair for swinging the one roller about the shaft of the other roller. The fanning out of the copies can thereby be optimally adjusted.

In accordance with a concomitant feature of the invention, the one roller has a diameter greater than that of the other roller of the deflecting roller pair.

Other features which are considered as characteristic for the invention are set forth in the appended claims.

Although the invention is illustrated and described herein as embodied in a device for separating out folded spoiled copies in web-fed rotary printing machines, it is nevertheless not intended to be limited to the details shown, since various modifications and structural changes may be made therein without departing from the spirit of the invention and within the scope and range of equivalents of the claims.

Figure 2:
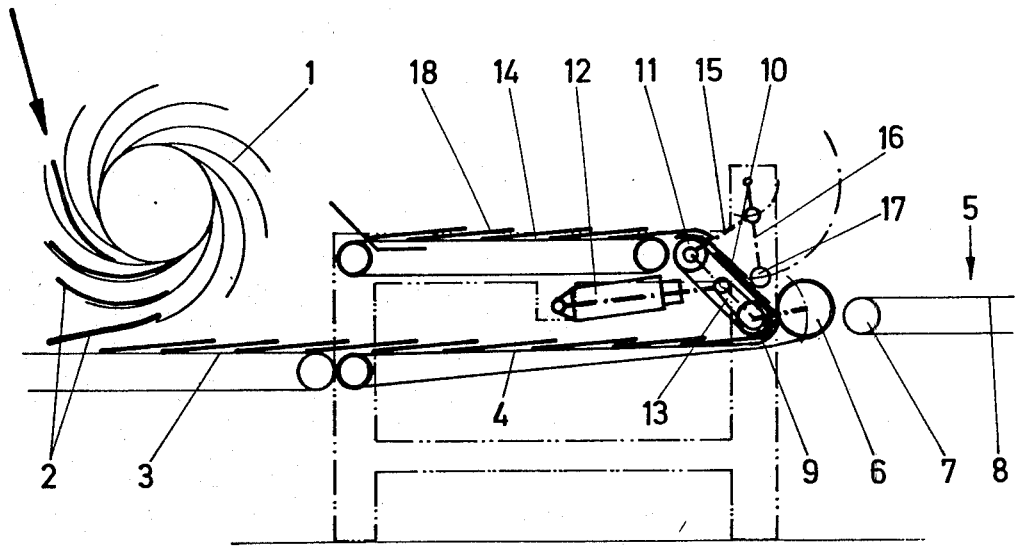
Figure 3:
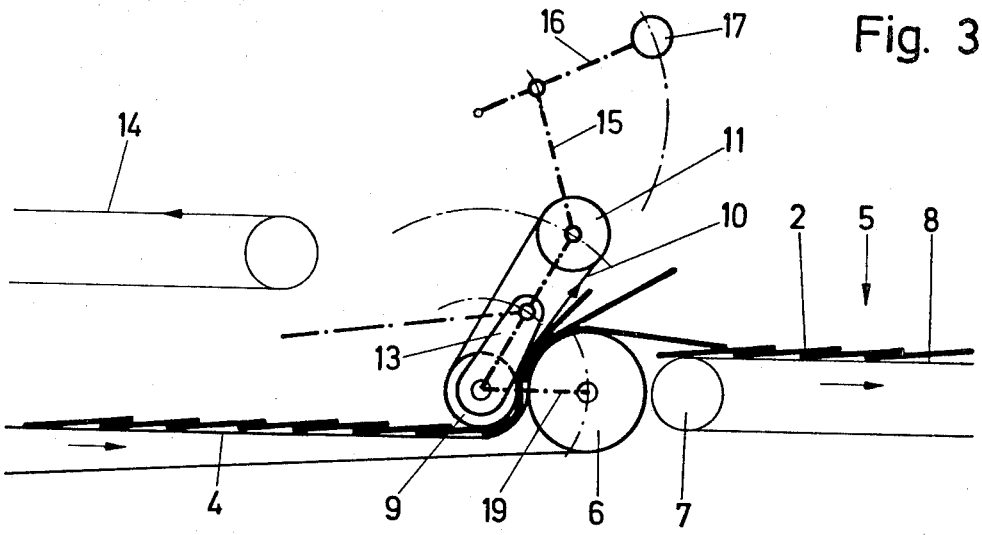
Figure 4:
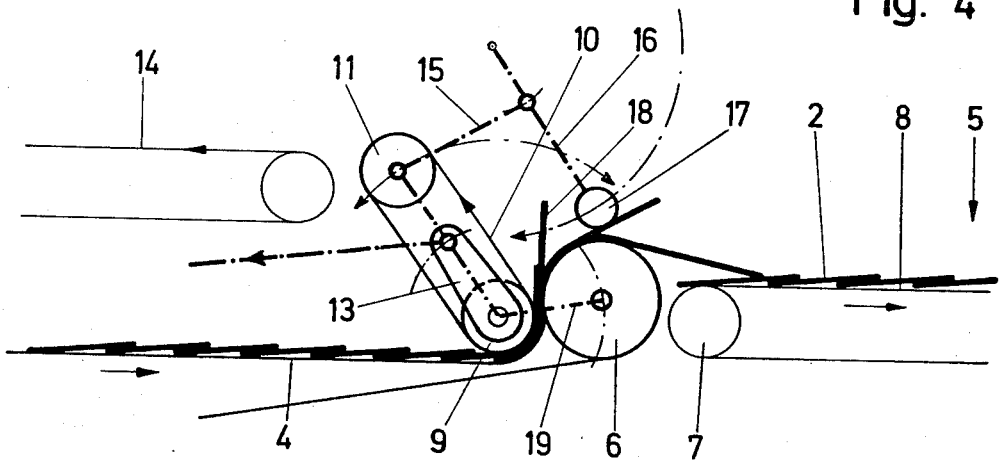
Figure 5:
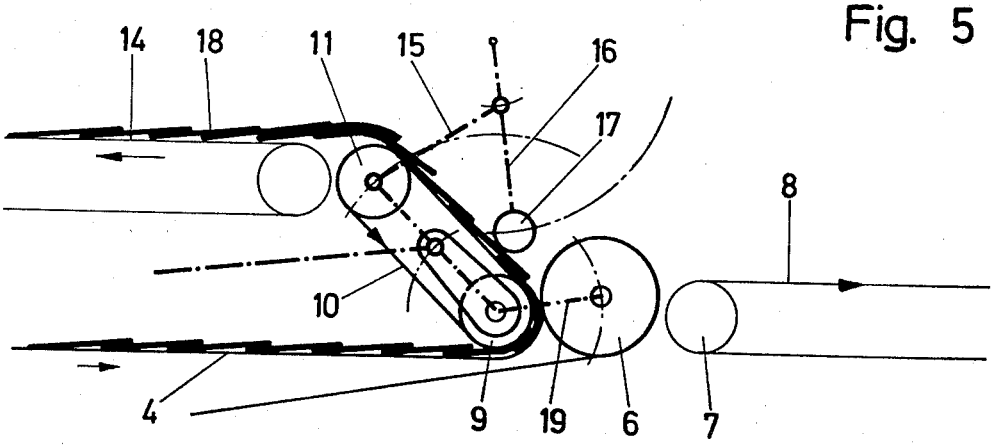

The construction and method of operation of the invention, however, together with additional objects and advantages thereof will be best understood from the following description of specific embodiments when read in connection with the accompanying drawings, in which:

FIGS. 1 and 2 are diagrammatic side elevational views of the device for separating out folded waste or improperly processed copies in a web-fed rotary printing machine showing, respectively, one operating phase thereof wherein a stream of properly processed copies is directed to a delivery and another operating phase thereof wherein a stream of improperly processed or waste copies are separated out;

FIG. 3 is an enlarged fragmentary view of FIG. 1;

FIG. 4 is a view like FIG. 3 showing a phase of operation of the device intermediate those shown in FIGS. 1 and 2 and wherein a belt line or run of a conveyor belt is swung backwardly out of operating condition, and a separating roller is simultaneously swung into operating condition; and FIG. 5 is an enlarged fragmentary view of FIG. 2 showing the phase of operation wherein the improperly processed or waste copies are conveyed onto a sorting belt.

Referring now to the drawing and first, particularly to FIG. 1 thereof, there is shown a vane wheel or shoefly 1 from which folded printed copies 2 are deposited in overlapping fashion, like the scales of a fish, upon a conveyor belt 3 and are fed from the latter over a conveyor belt 4 to a delivery system 5. The conveyor belt 4 winds around a first roller 6 of a roller pair while the second roller 7 of the roller pair carries a belt line or upper run 8 of a conveyor belt of the delivery system 5. During normal production by the machine, the printed copies are moved in overlapping fashion i.e. fish scale-like, on the respective conveyor belts and, at the end of the delivery 5 are either removed manually or are fed to further processing stations.

As viewed in the direction of conveyance of the printed copies 2, there is located forward of the roller pair 6, 7 and somewhat horizontally aligned therewith, a deflecting roller 9 which diverts the conveyor belt 4 with the stream of copies 2 downwardly so that a fanning out of the printed copies 2 is effected between the deflecting roller 9 and the first roller 6. The deflecting roller 9 drives a short belt line or run 10 at the speed of the conveyor belt 4. The belt run or line 10 is guided by means of a tensioning roller 11 which swivels about the deflecting roller 9. In the operating position of the belt line or run 10, the printed copies 2 are deflected in such a manner that they are fed to the delivery 5 in an undisturbed fish scale-like stream.

By means of a pneumatic cylinder 12 or the like, the belt line or run 10 with the tensioning roller 11 may be swung backwardly by means of a rocking lever 13 so that the spoiled or waste copies are directed onto a sorting or distributing belt run or line 14, as shown in FIG. 2. The tensioning roller 11 is coupled by means of a coupling bar 15 to another rocking lever 16 which carries a separating roller 17 at the outer end thereof. When the belt line or run 10 is swung back to the position thereof shown in FIG. 2, the separating roller 17 is simultaneously swung in between the fanned-out printed copies 2 by means of the coupling bar 15 and the rocking lever 16, due to which separation of the flow of copies occurs. The printed copies 2 travel in overlapping or fish scale-like manner in a steady stream, contingent upon the reversed, advantageous interlinking of the scales, by means of swung-back belt line or run 10 to the sorting or distributing belt 14 from which they are removed by an operator. Instead of the waste or spoiled copies, it is also possible to remove a given number of test copies or samples during production by the machine.

In FIG. 3, the belt line or run 10 is disposed in normal operating position wherein the folded printed copies 2 are directed to the delivery system 5. FIG. 4 shows the instant at which the belt line or run 10 is swung back, the separating roller 17 swinging into the fanned-out stream between two successive copies and the trailing copy being moved onto the belt line or run 10, so that it is fed by the belt line or run 10 to the sorting or distributing belt 14. This trailing copy is one of the waste or spoiled copies 18. In order to adjust the fanning-out to the characteristics of the respective printed copies, the roller 6 is swivellable about the deflecting roller 9 by means of the lever 19.

FIG. 5 shows how the waste or spoiled copies 18 are directed onto the sorting or distributing belt 14 in a reversed or inverted, at all locations self-maintaining fish scale-like interlinkage and thereby being separated from the scale-like regular stream. After a prescribed number of waste or spoiled copies have been separated, the belt line or run 10 is swung back again into the operating position thereof shown in FIG. 3, so that the stream of copies is separated from the waste or spoiled copies, and the subsequent copies are again fed to the delivery 5. The swivelling movement of the belt line or run 10 may be controlled either manually or automatically, automatic control being exercisable in dependence upon or as a function of the overlappingly advanced printed copies.

There are claimed:

1. Device for separating out folded waste or spoiled copies in web-fed rotary printing machines at a delivery of a folding apparatus having a main conveyor belt whereon a stream of folded copies are transported in overlapping, fish scale-like arrangement comprising a roller pair adjacent the main conveyor belt for deflecting the stream of copies in a fanned-out manner, said deflecting roller pair including one deflecting roller rotatably supporting the main conveyor belt and, as viewed in transport direction of the stream of copies, another deflecting roller located upstream of said one deflecting roller and disposed in substantially horizontal alignment therewith, said other deflecting roller being engageable with the main conveyor belt so as to deflect it and the stream of copies in downward direction and thereby effect the fanning-out of the copies between said rollers of said deflecting roller pair, a short additional conveyor belt drivingly engaged by said other deflecting roller and swingable about said other deflecting roller into a normal operating position thereof for transporting properly printed copies to a delivery system and also swingable about said other deflecting roller into another operating position thereof for transporting spoiled copies to a distribution belt, a tensioning roller rotatably supporting said short additional conveyor belt and swingable therewith about said other deflecting roller, a linkage system comprising a rocking lever and a coupling bar coupling said rocking lever to said tensioning roller, a separating roller carried by said rocking lever at a free end thereof and being swingable in among the fanned-out copies by said linkage system as said short additional conveyor belt is swung about said other deflecting roller into said other operating position, said separating roller being engageable with the fanned-out copies for feeding the following spoiled copies in overlapping fish scale-like manner over said short additional conveyor belt to the distribution belt.

2. Device according to claim 1 including lever means for connecting said one roller to the shaft of said other roller of said deflecting roller pair for swinging said one roller about said shaft of said other roller.

3. Device according to claim 2 wherein said one roller has a diameter greater than that of said other roller of said deflecting roller pair.

* * * * *